United States Patent [19]

Berard

[11] Patent Number: 4,976,437

[45] Date of Patent: Dec. 11, 1990

[54] METHOD OF PLAYING A BOARD GAME OF STRATEGY AND CONQUEST

[76] Inventor: Anthony S. Berard, 128 Birch Bark Dr., Fairview, Tenn. 37062

[21] Appl. No.: 451,646

[22] Filed: Dec. 18, 1989

[51] Int. Cl.[5] ..... A63F 3/02

[52] U.S. Cl. ..... 273/261; D21/24

[58] Field of Search ..... 273/260, 261, 262; D21/14–16, 24

[56] References Cited

U.S. PATENT DOCUMENTS

| | | | |
|---|---|---|---|
| D. 143,456 | 1/1946 | Willett | D21/16 |
| 1,405,988 | 2/1922 | Erwin | 273/260 |
| 4,364,568 | 12/1982 | Tracy | 273/242 |
| 4,684,134 | 8/1987 | Nelson | 273/261 |
| 4,696,478 | 9/1987 | Farrell | 273/261 |
| 4,753,441 | 6/1988 | Braus et al. | 273/255 |
| 4,779,875 | 10/1988 | Sypal | 273/253 |
| 4,886,279 | 12/1989 | Taylor | 273/261 |

FOREIGN PATENT DOCUMENTS

| | | | |
|---|---|---|---|
| 2186198 | 8/1987 | United Kingdom | 273/260 |

*Primary Examiner*—Benjamin Laynod

*Attorney, Agent, or Firm*—Leon Gilden

[57] ABSTRACT

A board game including characteristics of strategy and conquest are utilized incorporating a game board provided with a series of intersecting vertical and horizontal hexagons including square spaces sandwiched thereabout. The intersection of the hexagons provide intersection points for positioning of game pieces, as well as positioning game pieces within the first two rows of opposing hexagons and squares on opposite sides of the game board. The game board includes medieval character tokens provided with predetermined moves to effect capture and conquest to opposing pieces of opposing respective players.

1 Claim, 4 Drawing Sheets

METHOD OF PLAYING A BOARD GAME OF STRATEGY AND CONQUEST

BACKGROUND OF THE INVENTION

1. Field of the Invention

The instant invention relates to strategy games, and more particularly pertains to a new and improved board game including characteristic of strategy to effect conquest of opposing player tokens.

2. Description of the Prior Art

The prior art has utilized chess and checker-like game playing pieces for movement about a game board to capture opposing players. The instant invention relates to such a game incorporating an increased complexity of player movements and choices in movement about a playing field. The prior art has frequently utilized such games wherein their simplicity of movement has failed to produce an appeal to players requiring the challenge and complexity of advanced strategy game as set forth by the instant invention. Examples of the prior art include U.S. Pat. No. 4,364,568 to Tracy utilizing a game board provided with a grid-like pattern of squares of varying patterns and colors to effect movement of playing pieces of opposing players.

U.S. Pat. No. 4,696,478 to Farrell provides a matrix within a game board in the configuration of a cross incorporating a neutral zone which may be occupied by only one piece or token of an opposing player to effect capture by opposing players.

U.S. Pat. No. 4,684,134 to Nelson provides a game board for play by two opposing players utilizing hexagons and triangles for positioning of players, but fails to provide the added interest of utilizing the intersections in combination with hexagons and squares as does the instant invention.

U.S. Pat. No. 4,779,875 to Sypal provides a game board having vertical and horizontally aligned rows of rectangular spaces wherein a die and numbered cards or a spinner is included to provide a chance device to effect movement of tokens about the game board.

U.S. Pat. No. 4,753,441 to Braus provides a war game-type playing field formed with various patterns within the grid work, wherein each set of playing pieces includes a series of different types of pieces having predetermined movements and capable of removing opponents according to the rules of the game and by result of random numbers generated by chance tokens, such as dice within playing of the game.

As such, it may be appreciated that there is a continuing need for a new and improved board game utilizing player strategy to effect conquest of an opponent as set forth in the instant invention that addresses both the problems of ease of learning of the rules of the game, as well as utilizing enhanced and advanced strategy play and in this respect, the present invention substantially fulfills this need.

SUMMARY OF THE INVENTION

In view of the foregoing disadvantages inherent in the known types of strategy games now present in the prior art, the present invention provides a board game of strategy and conquest wherein the same utilizes a matrix of hexagons, squares, and intersections of vertically and horizontally aligned hexagons to effect positioning and movement of various tokens about the game board. As such, the general purpose of the present invention, which will be described subsequently in greater detail, is to provide a new and improved board game of strategy and conquest which has all the advantages of the prior art strategy games and none of the disadvantages.

To attain this, the board game of strategy and conquest set forth by the instant invention includes a game board formed with a generally planar surface including a symmetrically arranged matrix of squares, horizontal rows of hexagons, and vertical columns of hexagons wherein the intersection of the vertical and horizontal hexagons provide additional strategy positions for additional game pieces to be utilized in playing of the instant invention. The tokens utilized are of medieval origin to enhance interest and playing of the game and incorporate dragons, an emperor, a queen, a troll, a unicorn, and a mystical piece known as a Magus, as well as apprentice type sorcerers and further pieces known as sprites.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game of strategy and conquest which has all the advantages of the prior art strategy games and none of the disadvantages.

It is another object of the present invention to provide a new and improved board game of strategy and conquest which may be easily and efficiently manufactured and marketed.

It is a further object of the present invention to provide a new and improved board game of strategy and conquest which is of a durable and reliable construction.

An even further object of the present invention is to provide a new and improved board game of strategy and conquest which is susceptible of a low cost of manufacture with regard to both materials and labor, and which accordingly is then susceptible of low prices of sale to the consuming public, thereby making such board games of strategy and conquest economically available to the buying public.

Still yet another object of the present invention is to provide a new and improved board game of strategy and conquest which provides in the apparatuses and methods of the prior art some of the advantages thereof, while simultaneously overcoming some of the disadvantages normally associated therewith.

Still another object of the present invention is to provide a new and improved board game of strategy and conquest wherein the same utilizes opposing tokens positioned at strategic positions about the symmetrically arranged board to effect capture and conquest of opposing players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 10 and 11 are top orthographic plan views of respective diagonal and vertical/horizontal movements available on the game board of the instant invention.

DESCRIPTION OF THE PREFERRED EMBODIMENT

Figure 1:
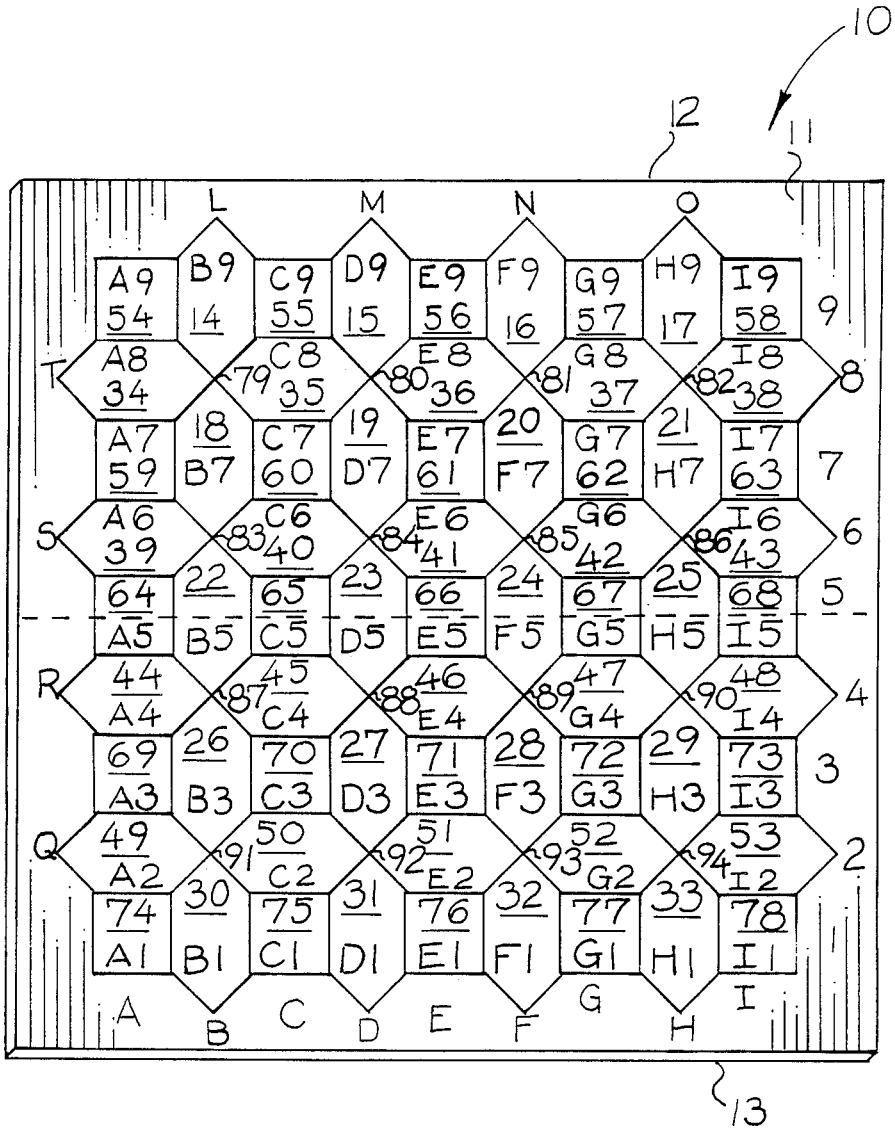
FIG. 1 is a top orthographic plan view of the game board of the instant invention.

With reference now to the drawings, and in particular to FIGS. 1 to 11 thereof, a new and improved board game of strategy and conquest embodying the principles and concepts of the present invention and generally designated by the reference numeral 10 will be described.

More specifically, the board game of strategy and conquest 10 essentially comprises a game board 11 formed of a rigid planar plate member including an upper surface, first player side 13, and an opposed second player side 12 at an opposite side of the board. The game board is defined by a matrix of symmetrically arranged openings defined by twenty vertical hexagons arranged in four columns defined by numerals 14 through 33, with intersecting horizontal hexagons 34 through 53 defining twenty such horizontal hexagonal spaces. Symmetrically arranged in a sandwiching relationship to each of the hexagons 14 through 33 are a series of twenty-five squares defined by squares 54 through 78. The vertical and horizontal hexagons, as enumerated above, intersect to define hexagonal intersection points 79 through 94. The hexagonal intersection points provide for token positioning of tokens designated as Sprites, with four such Sprites provides each opposing player to be arranged at opposing first and second player sides 13 and 12.

Figure 2:
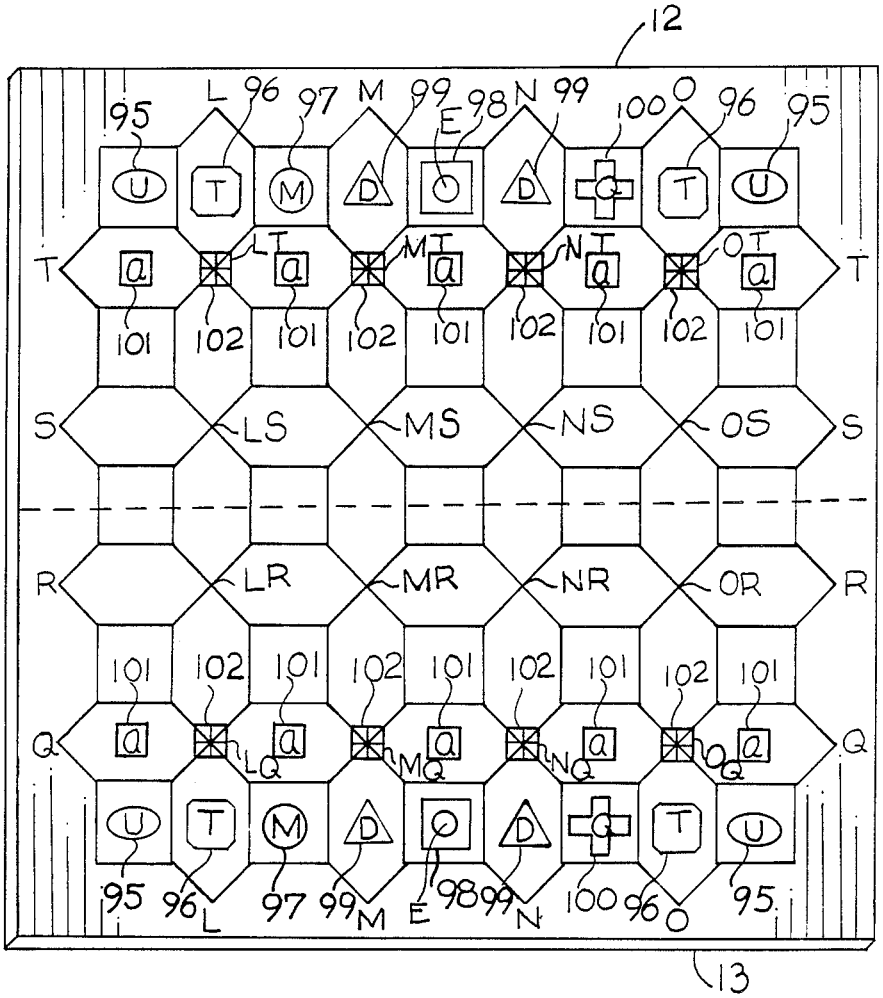
FIG. 2 is a top orthographic plan view of the game board of the instant invention illustrating positioning of opposing tokens of opposing players.
Figure 3:
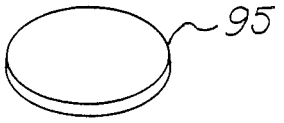
FIGS. 3, 4, 5, 6, 7, 8, and 9 are isometric illustrations of the various tokens utilized by the board game of the instant invention.
Figure 4:
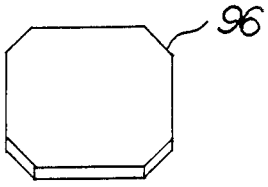
Figure 5:
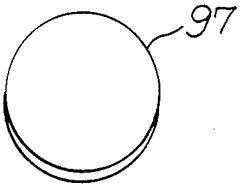
Figure 6:
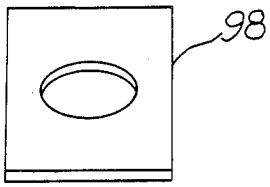
Figure 7:
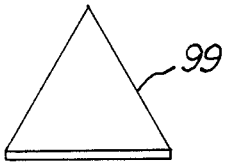
Figure 8:
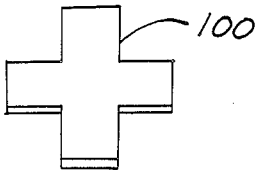
Figure 9:
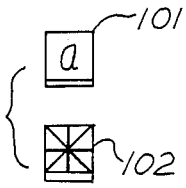

FIG. 2 is illustrative of player positioning at the outset of each game. A designated player, either of the first player side 13 or the second player side 12, is predetermined to go first, and typically the first player side 13 is so chosen. The columns and rows of the game board are designated as columns A, B, C, D, E, F, G, H, and I, as indicated in FIG. 1, to designated the nine columns of squares and horizontal hexagons. The rows are indicated and read from bottom to top as rows 1 through 9 to include the so-designated squares and vertical hexagons, as illustrated in FIG. 1. The hexagonal intersection points 79 through 94 are determined by intersecting letters, wherein the letters "L", "M", "N", and "O" indicated at the uppermost portion of the board adjacent the second player side intersect with the horizontal hexagons "T", "S", "R", and "Q", as indicated in the left vertical portion of the game board, wherein for example hexagonal intersection point 79 would be indicated as point LT, wherein the square 54 would be indicated by the designation "A9" for example. In this manner, the charting of the various moves of the players may be accounted for by each opposing player.

Each side is awarded tokens, as illustrated in FIGS. 3 through 9. Each side is accordingly awarded two unicorn tokens, ninety-five of a generally oval configuration, two troll tokens, ninety-six of an octagonal configuration, a Magus token 97 of a circular configuration, a single emperor token 98 of a square designation with an oval or circular central opening, two triangular dragon tokens 99, a queen token defined as a crucifix 100, five apprentice square tokens 101, and four Sprite square designation tokens 102 indicated with a predetermined pattern, as illustrated to distinguish the Sprite tokens. The tokens are arranged in a mirror image opposed to one another with the second player tokens occupying the rows 9 and 8 and the hexagonal intersection points 79, 80, 81, and 82, while the first player tokens occupy rows 1 and 2 initially and include the hexagonal intersection points 91, 92, 93, and 94, as illustrated in FIG. 2 for example.

MOVEMENT OF THE TOKENS

The Unicorn: The unicorn is available to move both vertically and horizontally and is blocked by a Sprite token and is distinguished from other players by not being captured by a Sprite token when the unicorn token is hopped over by that token. The unicorn token may capture in its movement an opposing unicorn token, an opposing troll token, an opposing dragon token, an opposing sorcerer token, (a sorcerer token is achieved by an apprentice token attaining promotion to an elevated status known as sorcerer, to be discussed below), an emperor, and an apprentice token, and queen token.

The troll token: A troll token may move in an "L" shaped configuration of a combination of three spaces incorporating vertical and horizontal movements and may be blocked by a Sprite token, but is not captured if hopped over by the Sprite token. Conversely, the troll token may capture the following tokens unless protected by a Sprite token, including the unicorn token, the troll token, the dragon token, the queen token, the sorcerer token, the emperor token, and an apprentice token.

Figure 11:
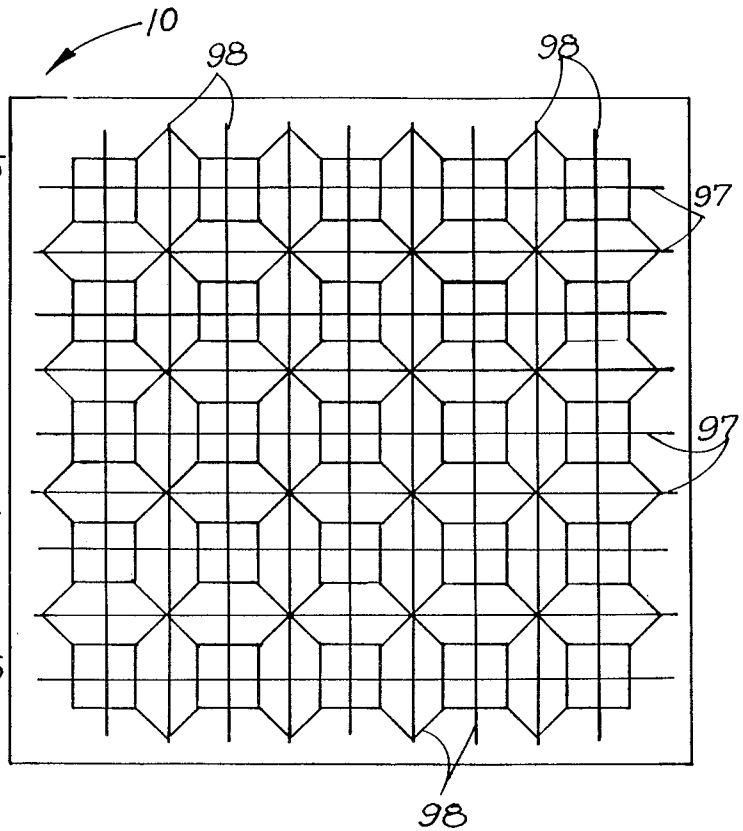
Figure 11A:
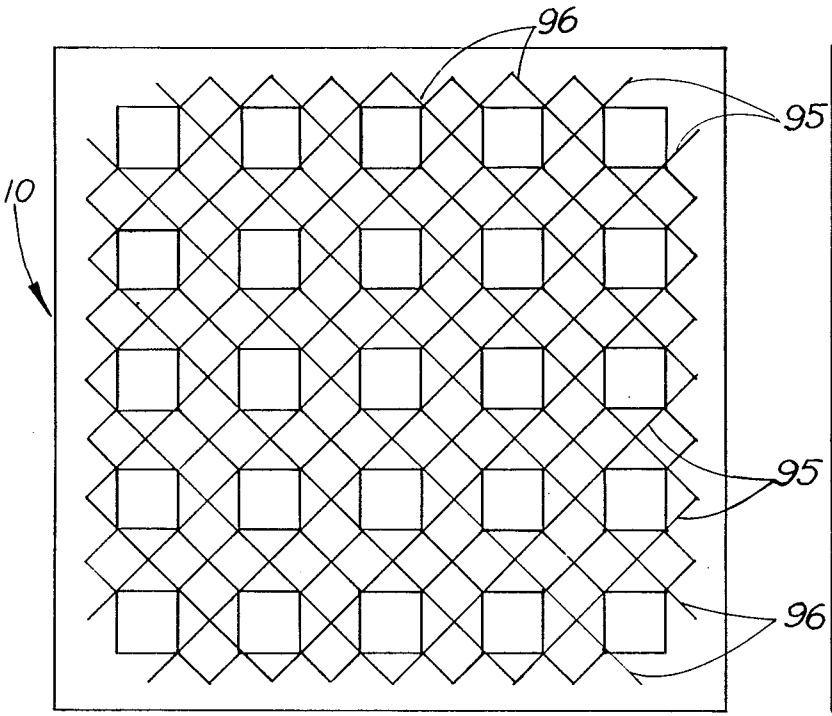

Dragon token: A dragon token moves along the diagonals of the game board indicated by numerals 95–96 to indicate the orthogonally oriented diagonal movement through adjacent hexagonal spaces. The orthogonally oriented vertical/horizontal movements are indicated in FIG. 11 by numerals 97–98 respectively. The dragon token may be blocked by a properly positioned Sprite token, but is not captured by that Sprite token if so hopped over by the Sprite token, and may in turn unless protected by a Sprite token capture an opposing unicorn token, troll token, opposing dragon tokens, opposing queen token, the sorcerer token, the emperor token, and an apprentice token.

Queen token: The queen token may move in all directions including vertical, horizontal, and diagonal, and is blocked by a Sprite token but is not captured by that token if hopped over by such token, and during its movement unless the opposing token is protected by a Sprite token, may capture the opposing unicorn, troll, dragon, queen, sorcerer, emperor and apprentice tokens.

Magus token: The token may move in two or three hops within a vacant space available to it and is not blocked by a Sprite token during its movement and may capture and kill a Sprite token during its movement, and in turn may be captured by a Sprite token and will capture any opposing player that it directly hops over in its movement about the game board.

Sorcerer token: The sorcerer token may move in all directions including vertical, horizontal, and diagonal and is not blocked by a Sprite token, but is captured by a Sprite token if so positioned. The sorcerer token may capture an opposing unicorn, troll, dragon, queen, Magus, sorcerer, emperor, and apprentice token in its movement, and sprite in special movement.

Emperor token: The emperor token may also move one space in any direction including vertical, horizontal, and diagonal and is not blocked by a Sprite token and is not captured by a Sprite if it is hopped over by an opposing Sprite token, and may in turn capture a unicorn, troll, queen, dragon, Magus, sorcerer, emperor, and apprentice token in its movement about the game board.

Apprentice token: The apprentice token may move one or two spaces at its option on its first opening move and then may move only one space forwardly to an opposing player side. The apprentice token may move only one position on a hex to capture an opposing unicorn, troll, dragon, queen, sorcerer, and emperor token, and apprentice. It is not blocked by Sprite and not captured if hopped over by Sprite.

Sprite token: The sprite token may move to an opposing point defined by the hexagonal intersections, as discussed above, and may capture other sprite tokens, as well as the Magus and sorcerer tokens in its movement. It is noted that the sprite token is available to protect its opposing emperor, but when a player loses its Magus token, that sprite token of that player is no longer available to protect that respective emperor token.

The Unicorn token in its vertical and horizontal movements may be blocked by a sprite token. The troll token in its "L" shaped movement of three spaces combining horizontal and vertical spaces is blocked by the sprite token, as noted. The sprite tokens do not block the squares and may only block the four hexagons that the sprite token occupies in the intersection of four hexagons defined by two vertical and two horizontal hexagons, for example as illustrated by the intersection 79 defined by the vertical hexagons 14 and 18 and the horizontal hexagons 34 and 35. Those hexagons 14, 18, 34, and 35 are the hex on the block by that particular sprite token in the example given. Essentially for example, a troll is not prevented from movement from attacking squares, even though the patrol may pass through protected hexagons but may terminate its movement on a square to effect the capture of an opposing token. Accordingly, a dragon may never be positioned on a square and is blocked by the Sprite tokens in its positioning. When a queen token is positioned on a square, the queen token has four directions of essential movement while on a hexagon, however, she may be provided with eight as there are no diagonals available from a square, as may be illustrated in FIGS. 10 and 11, in providing respective paths of movement of the diagonals 95–96 as opposed to the horizontal and vertical movement of the tokens by the paths 97 and 98. The queen may be blocked by a Sprite token. The pieces that are blocked by Sprite tokens are the queen, the unicorn, the dragon, and the troll tokens, in the Sprite's realm of influence, as noted above, in the intersection of the vertical and horizontal hexagons. The troll token may be blocked by a Sprite token and may capture or move into a square, in that a Sprite has no ability to control movement within the squares 54–78. The emperor, Magus and apprentice tokens are not effected by the Sprite's influence, wherein the emperor tokens may move one spot in any direction. The emperor is the object of the game and if the emperor is captured by an opposing player, the game is at that juncture completed. If an apprentice token defined by the tokens 101 moves to an opposing base row, i.e. if the first player side tokens move to the row 9 or if the second player side apprentice tokens move to the opposing row 1, that player token becomes a sorcerer token, wherein the sorcerer may move diagonally and vertically as well as horizontally and not be effected by opposing Sprite tokens. It may also capture an opposing Sprite token by a vertical or horizontal straight line movement onto an opposing Sprite token position. For example, if the sorcerer token is on space E9 and the Sprite token is on space NT, the sorcerer token may make a straight-line hop to G7 through the intersection 81 and may effect capture of the opposing Sprite token. A sorcerer token may only move in that path if there is a Sprite token to be so captured. Sprite tokens in summary may only capture those pieces that may in turn capture them, such as a Magus, or a sorcerer token. Further it is to be noted that the maximum number of opposing pieces that a Magus token may capture is five.

The opposing players accordingly take sequential turns in effecting their moves until capture of all opposing players, or particularly the emperor token, is effected.

As to the manner of usage and operation of the board game of the instant invention, the foregoing is believed to describe the use and practice of the game of strategy and conquest, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A method of playing a board game, comprising the steps of, providing a game board including a first player side and a second player side positioned on opposing sides of the game board, wherein the game board includes a symmetrical matrix of spaces including first spaces defined by equally spaced columns of vertically arranged hexagonal spaces, second spaces defined by equally spaced rows of horizontally configured hexagonal spaces, and third spaces defined by square spaces, the square spaces symmetrically arranged and positioned between the vertical and horizontal hexagonal rows and columns of first and second spaces respectively, wherein each vertical hexagonal space and each horizontal hexagonal space is sandwiched by a plurality of square spaces, and each intersection of horizontal and vertical hexagonal spaces defines hexagonal intersection points, and a plurality of opposing player tokens provided each opposing player for initial arrangement in a mirror-like image relative to one another on the game board, and wherein each player with a plurality of first tokens, a plurality of second tokens, a single third token, a plurality of fourth tokens, a single fifth token, a single sixth token, a plurality of seventh tokens, and a plurality of eighth tokens, and including the step of first player side and second player side arranging opposing tokens in a mirror image relationship within a plurality of rows of spaces adjacent each respective first end player second side, and the positioning of the first, second, third, fourth, fifth, and sixth tokens of the first player side and a second player within adjacent square and hexagonal spaces of a first row adjacent the respective first and second player sides, and further positioning the seventh token within hexagonal spaces of a second row adjacent each respective first and second player side, and further including the step of initially positioning the eight tokens at the intersections of the horizontal and vertical hexagonal spaces of the first and second rows of the first and second player sides, and directing the first token to effect movement vertically and horizontally, and directing the second token to effect "L" shaped movements including three spaces, and directing the third token to effect movement in three spaces, and directing the fourth token to effect diagonal movement, and directing the fifth token to effect movement in one space, and directing the sixth token to effect a selective vertical, horizontal, or diagonal movement, and directing the seventh token to effect movement initially of one or two spaces and subsequently of one space, and directing the eighth token to effect movement to opposing intersections to effect capture of opposing tokens in continuing play according to standard rules of chess until an opposing fifth token is captured.

* * * * *